United States Patent [19]

Tsumura et al.

[11] Patent Number: 5,046,004

[45] Date of Patent: Sep. 3, 1991

[54] APPARATUS FOR REPRODUCING MUSIC AND DISPLAYING WORDS

[75] Inventors: Mihoji Tsumura; Shinnosuke Taniguchi, both of Osaka, Japan

[73] Assignee: Mihoji Tsumura, Osaka, Japan

[21] Appl. No.: 372,029

[22] Filed: Jun. 27, 1989

[30] Foreign Application Priority Data

| | | | |
|---|---|---|---|
| Dec. 5, 1988 | [JP] | Japan | 63-308503 |
| Jan. 10, 1989 | [JP] | Japan | 1-3086 |
| Jan. 12, 1989 | [JP] | Japan | 1-5793 |
| Jan. 19, 1989 | [JP] | Japan | 1-11298 |
| Feb. 15, 1989 | [JP] | Japan | 1-35608 |
| Feb. 21, 1989 | [JP] | Japan | 1-40717 |
| Mar. 1, 1989 | [JP] | Japan | 1-50788 |

[51] Int. Cl.[5] ..... G10H 7/00

[52] U.S. Cl. ..... 364/419; 84/601; 84/602; 84/603; 84/645; 360/32; 360/48

[58] Field of Search ..... 364/419, 900 MS; 358/903; 369/59; 84/601, 602, 603, 645; 360/32, 48

[56] References Cited

U.S. PATENT DOCUMENTS

| | | | |
|---|---|---|---|
| 4,295,154 | 10/1981 | Hata et al. | 358/4 |
| 4,581,484 | 4/1986 | Bendig | 364/900 |
| 4,587,643 | 5/1986 | Manen et al. | 369/32 |
| 4,942,551 | 7/1990 | Klappert et al. | 364/900 |

OTHER PUBLICATIONS

Swearingen, "A MIDI Recorder", Byte Magazine, Fall 1985, pp. 127–138.

Anderton, "CD & MIDI & Graphics", Electronic Musician, 9/88, pp. 43–49.

*Primary Examiner*—Jerry Smith
*Assistant Examiner*—Steven Kibby
*Attorney, Agent, or Firm*—Brumbaugh, Graves, Donohue & Raymond

[57] ABSTRACT

Data for reproducing music and displaying words are composed of binary-coded digital signals. Such signals are down-loaded via a public communication line, or data corresponding to a plurality of musical pieces or songs are previously stored in an apparatus, and the stored data are selectively processed by a CPU. In the instrumental music data, trigger signals are existent for progression of processing the words data, whereby the reproduction of music and the display of words are linked to each other. The music thus reproduced is utilized as background music or for enabling the user to sing to the accompaniment thereof while watching the words displayed synchronously with such music reproduction.

24 Claims, 7 Drawing Sheets

APPARATUS FOR REPRODUCING MUSIC AND DISPLAYING WORDS

BACKGROUND OF THE INVENTION (a) Field of the Invention

The present invention relates to an apparatus capable of selecting a desired musical piece or song from a data base of a plurality of binary-coded musical pieces or songs and words thereof, and reproducing the selected musical piece while displaying the words thereof synchronously with such reproduction. The apparatus includes a unit for enabling the user to sing with a microphone while watching the words displayed in accordance with progression of the reproduced music. The apparatus further includes a means for down-loading the data via a public communication line.

(b) Description of the Prior Art

To enable a user to enjoy singing a song with a microphone at home or in a restaurant while watching the words visually represented on a display device simultaneously with the reproduced music, it has been necessary heretofore to prepare prerecorded tapes or optical discs and an apparatus for reproducing them.

In such apparatus, when the user wants to sing desired songs, or when some new musical pieces are released, it becomes requisite for him to successively add recorded tapes or optical discs to his repertory. However, since there exist a great number of known musical pieces or songs and new ones are released every month one after another, great expense is incurred if all of such new releases are to be stored. Furthermore, arises a need for providing a suitable place to store the recorded tapes and so forth.

In order to eliminate the above disadvantages, there may be contrived a means of transmitting music via a wire broadcasting system and allowing the listener to sing in accordance therewith. However, in such arrangement, it is impossible for the receiving side to select a desired musical piece or song at a time available for singing time for singing.

In view of such circumstances, there has been developed an improved system which constitutes a network comprising a host computer for sending digitized music signals to a plurality of terminal apparatus. According to this system, personal computers are employed as terminal units, and digital signals are transmitted thereto from a data base stored in the host computer. A desired musical piece or song is analyzed by an incorporated programmable sound generator composed of an integrated circuit (IC) and is controlled in the described language. Since such IC can be produced at low cost, each terminal unit can be rendered less expensive. On the other hand, however, the capability of the IC itself is so low that fine control of the sound volume cannot be executed in multiple steps. Furthermore, it is impossible to carry out fine setting of the duration of musical notes or to perform analysis for repetition of the musical piece. Consequently, some disadvantages are unavoidable including lack of musically expressive capability eventually resulting in failure to attain satisfactory music reproduction.

In another known system realized practically, music is transmitted through a telephone line and reproduced by the use of Videotex. However, it is still impossible for such system to achieve fine control of the sound volume due to limited the amount of data. In addition, since the number of simultaneously emittable tones to form a chord is limited to five or six, any sound composition with a great sonic tonal range is impossible. Furthermore, since there are only 15 notes, expressional capability is inadequate for employing the above apparatus for commercial use.

Meanwhile, there is known a PCM recording/-playback system which converts each musical piece or song into digital signals units. According to such system, in which the musical piece or song is analyzed sequentially in time series, the digital amount needs to be displayed so that the total amount of the required data becomes extremely large. Therefore, although the expressional capability may be sufficient, the amount of the required data is excessive causing problems regarding the storage of multiple musical pieces or songs in a memory unit of a fixed capacity, and regarding data transmission through a public communication line.

Furthermore, with regard to display of words also, the words encoded in binary notation are transmitted together with the instrumental music data, and then are visually represented on a display device such as a cathode-ray tube (CRT). Also, it is necessary that the display of words be performed synchronously with the reproduction of the musical piece or song, so as to inform the user of the current portion of the words by changing the color of the words already sung or by indicating such portion with an arrow or the like. However, in the process of partially erasing the words or changing the color thereof by the use of the aforementioned Videotex, another problem arises in that the speed of replacement is reduced lower in displacing or erasing the words. Therefore it becomes necessary each time to replace the entire CRT-screen display, eventually resulting in loss of synchronism with the music being reproduced.

SUMMARY OF THE INVENTION

An object of the present invention resides in providing an apparatus which, on the premise that it is connected to an external host computer via a public communication line, enables a user to select any desired musical piece or song and to sing to the accompaniment of the reproduced music merely by the use of a terminal unit without the necessity of stocking a multiplicity of recorded tapes or optical discs. The public communication line is defined here to imply both an analog telephone line and an ISDN-standard digital line.

It is another object of the present invention to provide an apparatus which is capable of producing digital music data by encoding a large collection of musical pieces or songs, thereby curtailing both the data transmission and processing needs, while realizing satisfactory music reproduction with abundant expression.

A further object of the invention is to provide an apparatus adapted to perform rapid selection of musical pieces or songs by effectively utilizing a large amount of the data stored in a memory unit incorporated in the apparatus.

Still another object of the invention is to provide an apparatus which processes the words of each song in the form of binary signals and which, out of the totality of words visually represented on a display device, partially erases the words already sung or indicates with an arrow or the like the portion of the words being sung. The apparatus is further capable of adequately changing the background color of the displayed words and realizing proper progress of the words in accurate synchronism with the musical piece being reproduced.

In this specification, "composite music data" signifies binary-coded data including instrumental music play, words and file data; "instrumental music data" signifies binary-coded data of the instrumental music play; and "words data" signifies binary-coded data of the words, respectively.

Any other objects, features and advantages of the present invention than those mentioned above will be more apparent from the following detailed description and the accompanying drawings.

BRIEF DESCRIPTION OF THE DRAWINGS

The accompanying drawings show preferred embodiments of the present invention, in which.

DESCRIPTION OF THE PREFERRED EMBODIMENTS

Hereinafter preferred embodiments of the present invention will be described with reference to the accompanying drawings.

Figure 1:
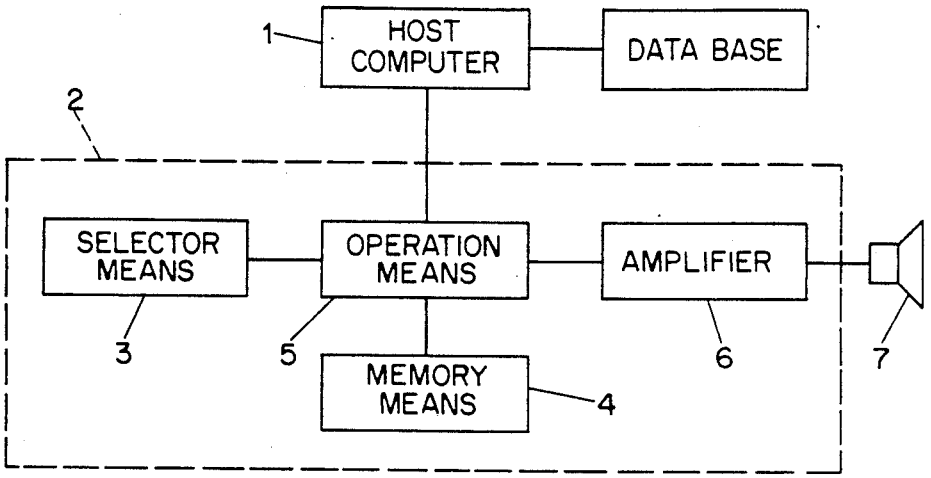
FIG. 1 is a schematic block diagram of the apparatus according to the invention.

FIG. 1 is a schematic block diagram of the apparatus according to the present invention, wherein a host computer 1 incorporates a data base composed of a multiplicity of composite music data formed by binary-coding instrumental play of musical pieces or songs and adding a data code to each of them. Denoted by 2 is a terminal apparatus of the present invention installed on the user's side for reproduction of music and display of words. The terminal apparatus 2 is in on-line connection to the host computer 1. Although the allowable number of such terminal apparatus 2 is naturally limited in conformity with the capability of the host computer 1, it is necessary to preset a sufficiently great number for prospective increase of the number of users in the future. Meanwhile, the composite music data stored as the data base may be any desired amount within the storage capacity of the host computer 1. For completely meeting the requirements from all users of the terminal apparatus 2, at least 300 musical pieces or songs will be needed.

The terminal apparatus 2 comprises a selector means 3 for down-loading desired music data from the data base by inputting the data code; a memory means 4 for storing the music data down-loaded from the data base via the selector means 3; a calculator means 5 for analyzing the stored binary music data and processing such data to convert the same into an analog signal; and an amplifier 6 for amplifying the analog signal. Denoted by 7 is a loudspeaker for outputting the reproduced signal as music. The selector means 3 is normally equipped with a ten-key device for inputting the data numerically.

In such arrangement, the operation of converting the instrumental music play into binary music data is performed by previously encoding with the further purpose of data compression by means of a virtual table, and, subsequently, the signals thus processed are stored as the data base. The memory means 4 is formed of a RAM, and the operation means 5 is formed of a 16-bit- or 32-bit high speed microprocessor. In the on-line connection between the host computer 1 and the terminal apparatus 2, a modem is interposed in the case of utilization of an analog telephone line, or an interface such as an Input/Output port is interposed in the case of utilization of a digital line of an ISDN system or the like.

In processing the data by the host computer 1, batch processing may be possible for each of the terminal apparatus, but since the uses of such apparatus are usually concentrated in a particular time period, it is preferred that input commands be processed by a time sharing system so as to shorten the wait time of the users for idle lines.

Figure 2:
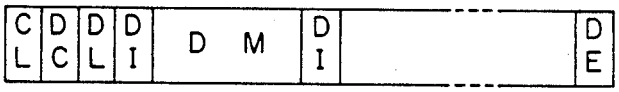
FIG. 2 schematically shows the format of unitary data.

FIG. 2 schematically shows the format of unitary a data unit, wherein CL (clear) is a data portion for erasing any unrequired data that remains in the memory means 4 at the data call time; DC (data code) denotes a discrimination code; DL (data length) is a signal to indicate the length of the data unit; DI (data identification) is a signal for data identification; DM (data music) is a data portion formed by binary-coding the instrumental music play; and DE (data end) is a signal to indicate the end of the music data. One unit of the music data includes CL, DC and DL added to the beginning of its format, but since the individual playing time is not fixed, storage space would be wasted if the data-unit size were allocated to the longest musical piece or song. Therefore, in the present invention, the music data is divided by determining a certain capacity (e.g. a maximum packet length of 256 bytes) as one unit, and the divided data are united mutually through DI to avert such waste in the data capacity. Furthermore, the data base can be formed without being restricted by the length of any musical piece or song. Since the time required in the operation means 5 for processing of the signal DL is extremely short, there never occurs any interruption of the music during reproduction, and discomfort to the user is prevented.

Regarding the operation of the apparatus described above, first the user connects the terminal apparatus 2 to the host computer 1 and inputs a data code corresponding to a desired musical piece or song to be reproduced, by manipulating the numerical keyboard or the like in the selector means 3. Then the host computer 1 retrieves the input signal and down-loads into the terminal apparatus 2 the music data designated by the data code.

The music data is processed by the operation means 5 after such data has been saved in the memory means 4, and subsequently the reproduced signal is outputted.

Although the description given in connection with FIG. 1 is concerned merely with the music data alone, it is a matter of course that if the words are binary-coded and included in the data base together with the music data as will be mentioned below, the words can be outputted by incorporating a display device of a CRT or the like in the terminal apparatus 2.

Figure 3:
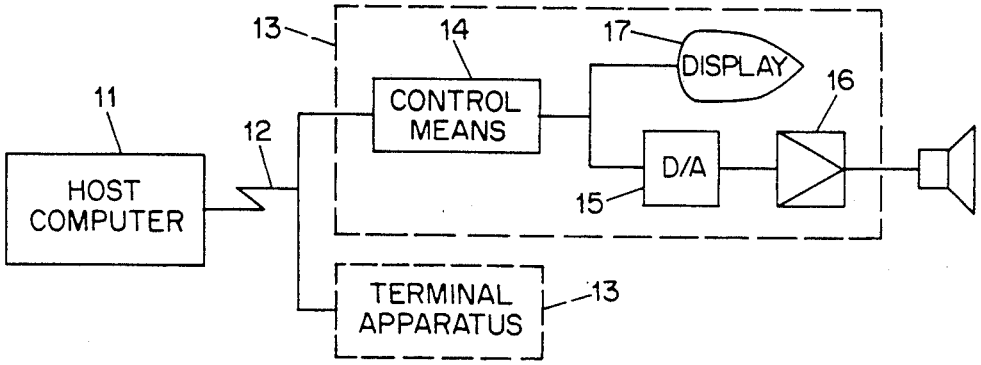
FIG. 3 is a schematic block diagram of a second embodiment of the invention.

FIG. 3 is a block diagram showing a second embodiment of the apparatus according to the present invention. This embodiment will be described below with reference to the diagram of FIG. 4 which represents the relationship among data groups. Denoted by 11 is a host computer equipped with a memory unit to store a data base composed of a plurality of composite music data. There are also shown a public communication line 12 connected to a plurality of terminal apparatus 13 installed on the users' side, and a control means 14 provided on the terminal side and fed with input digital signals via a modem or an I/O port. The control means consists of a CPU, a memory unit, an input unit such as a keyboard and so forth. Denoted by 15 is a digital-to-analog (D/A) converter connected to the control means 14. Its internal fundamental signal waveform and output level are controlled by the digital signal processed by the control means 14 and outputted in accordance with the time series. The signal converted into an analog form by the D/A converter 15 is amplified by the amplifier 16, and then the reproduced signal is emitted as music from the loudspeaker. Denoted by 17 is a display unit which is connected to the control means 14 and which serves to sequentially display the words corresponding to the reproduced musical piece or song.

As regards the means for reproducing a desired musical piece or song by the apparatus mentioned, first the user manipulates the keyboard of the control means 14 to designate the data code (normally discriminated by numerical value) added to the corresponding musical piece or song. Then a command is transmitted via the public communication line 12 to the host computer 11, and the required music data is down-loaded into the terminal apparatus 13 so that, after processing by the control means 14, the music reproduced and emitted from the loudspeaker while the words relevant to such musical piece or song are visually represented on the display device 17.

Figure 4:
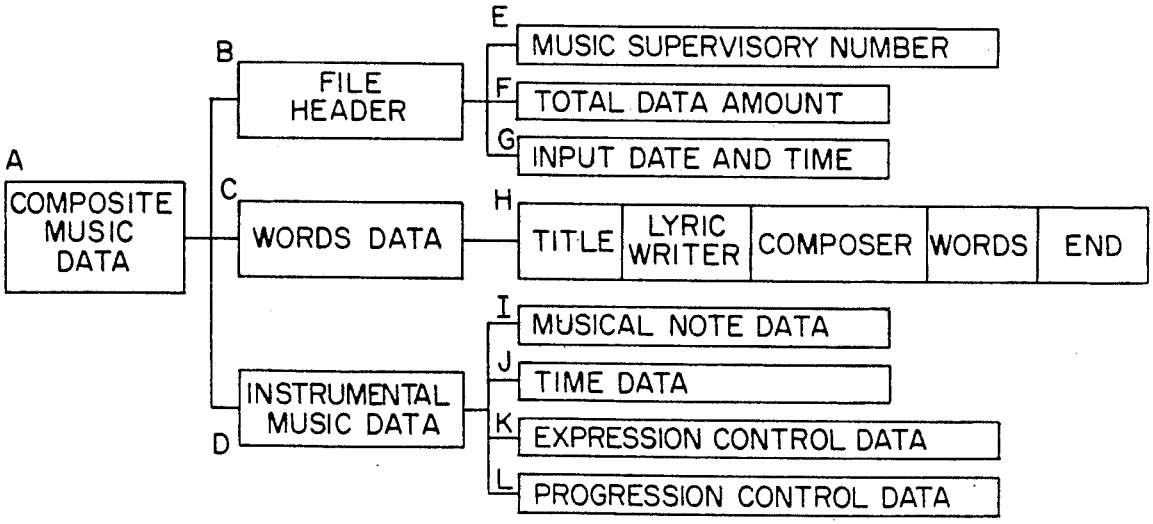
FIG. 4 shows the relationship among data groups.

As shown in FIG. 4, the composite music data consists of three groups, i.e. file header, words data and instrumental music data. Each file header is given by a serial song array number which functions as a data code to which a 32-byte storage space is allocated and which serves to specify the total data amount, input data, time and so forth. Meanwhile, there is allocated to the words data a maximum storage capacity of 8 kilobytes for the title, lyric writer, music composer, end code and variable-length words.

To the instrumental music data, there is allocated a maximum storage capacity of 54 to 85 kilobytes for musical note data, time data, expression control data and progression control data. Each musical piece or song is converted into a data base in the sequence of a file header (including data code), words data and instrumental music data.

As for the format of the instrumental music data, the present inventor has so contrived that, in the case of a musical instrument with a keyboard for example, the play data are derived from the operations of depressing or releasing the keys by a player, depressing or releasing a pedal for musical effects, or on-off action of the switch to designate a desired tone. Such operations are analyzed as quantitative numerical values and converted into digital signals, whereby specific digital data are obtained. The details of such digital data will be described below.

(1) Musical note data

The musical note data is composed of converted digital values representing which of the keys is depressed or released and the force or degree of such depressing. The data consists of a sound emission start command and a sound emission stop command.

(a) Sound emission start command

The start of sound emission is designated by 4 higher-order bits out of a predetermined byte unit, the staff line on the musical score for the melody is designated by the 4 lower-order bits, and the scale of the tones and the strength of the sound to be emitted are also designated. The scale covers a range of ten-and-a-half octaves and is designated in a range of 0 to 127 obtained by sequential numbering of half-notes. In this embodiment, a tone C is set as a value of 60.

(b) Sound emission stop command

The stop of sound emission is designated by 4 higher-order bits out of a predetermined byte unit, and the staff line on the musical score is designated by 4 lower-order bits. Following the sound emission stop command, the above-described scale is designated.

(2) Time data

The time data serves to designate the duration and the pause time of the individual data, and it is composed of a reference mark command and a lapse time command.

(a) Reference mark command

The reference mark command serves as a bar on the musical score and serves as a partition sign. In this embodiment, the sound emission of each musical note may be calculated by regarding the reference mark as a start point or from the beginning of the musical piece or song. However, if the calculation is executed from the reference mark, accurate instrumental play of the music can be attained even in case the musical piece or song is reproduced from any other position than the beginning thereof.

(b) Lapse time command

The elapsed-time command executes calculation of the time elapse from the reference mark or from the start of the musical piece or song, and its basic time unit is set to 10.42 msec. In case the instrumental play proceeds in such basic time unit, 120 beats are maintained per minute, but the tempo can be varied by changing the basic time unit.

(3) Expression control data

The expression control data is used in addition to the musical note data for further achieving faithful reproduction of the natural sound produced by, in a musical instrument, depressing the pedal or a key, and then applying modulation such as vibrato. The expression control data comprises a modulation command, an operational factor command, a tone command, a staff line modulation command, a fine change command and a words erase command. The expression control data is also adapted for designation of each staff line on the musical score.

(a) Modulation command

This command is used for applying vibrato to a desired scale per staff line through frequency modulation. The degree of such modulation can be designated by a numerical input.

(b) Operational factor command

The operational factor denotes an individual tone or a reproduction level per staff line, and the on-off action or the level setting can be designated and changed regardless of whether it is anterior or posterior to the start of reproduction. The above consists of a command for setting the kind of the operational factor and another command for designating the level. The kinds of operational factors include a portamento indicative of the gliding movement time to a different tone, a main volume indicative of the entire output level, a volume indicative of the output level in each staff line, a stereo balance indicative of the left-right output balance, a reverb indicative of the reverberation effect level, and functions of a damper pedal and a sostenuto pedal for emphasizing the acoustic effects.

(c) Tone command

The tone command is used for giving numerical values to present reference waveforms and designating them for individual staff lines. The commands correspond respectively to the standard waveforms of various string, wind and keyboard musical instruments.

(d) Staff-line modulation command

This command applies modulation to the entirety of the designated staff line through frequency modulation. The degree of such modulation can be designated by a numerical value.

(e) Fine change command

This command has a function of gradually increasing or decreasing the frequency to the staff line being reproduced, and is used in the case of exhibiting, for example, the choking effect of a guitar or the like. It is possible in each case to achieve a change of one octave.

(f) Words erase command

In this embodiment, the words of each song or musical piece are visually represented on a display device in accordance with reproduction of the musical piece. Since visual representation of the words already sung is no longer necessary, it is preferred that such words be erased from the screen of the display device to simplify the visual representation as well as to facilitate the singing. Therefore, this erase command serves to designate the number of words to be erased. If this number is properly designated in the data, the words are sequentially erased in accordance with the progression of the musical reproduction.

(3) Progression control data

This data serves to determine the progression of the reproduction of the musical piece, including the progression tempo in accordance with the musical reproduction, the portion of the musical piece to be repeated and the number of such repetitions, and the end portion thereof. This control data consists of a label command, a repeat command, a conditional repeat command, a time pattern command, a tempo command and an end command.

(a) Label command

This command indicates the beginning of repetition such as segno accompanied by a label number.

(b) Repeat command

This is a command for indicating the end of repetition and designating the label for return and the number of required repetitions, thereby setting the label number and the number of repetitions.

(c) Conditional repeat command

This is a command for designating shift to another specified label after completion of the operation by the repeat command. On the musical score, this command corresponds to a parenthesis.

(d) Time pattern command

This is a command executed at the beginning or at any intermediate point of the instrumental music data to determine the kind and the number of musical notes constituting one bar. This command designates both the numerators and the denominators of the musical notes individually, thereby determining the rhythm of the whole musical piece or song.

(e) Tempo command

This command is concerned with the aforementioned lapse time command, and serves to determine the tempo of the musical piece or song by designating the number of counts per basic unitary length of the lapse time. Therefore, the tempo becomes slower with increasing numerical value.

(f) End command

This is a command for indicating the end of reproduction of one musical piece or song. The end is represented by previously inputting a specific numerical value.

For the determination of of the standard lapse time and the scale, calculations are executed on the basis of the clock frequency obtained from the CPU in the control means 14.

In this embodiment, the sound volume data is divided into 127 levels, and the number of simultaneously emissible sounds is set to at least 32 while the number of tones is set to be greater than 127 for realizing the desired expression of the various effective sounds mentioned above. As for the basic time unit of musical notes, its length is set to 10.24 msec, and its integral multiples are utilized.

The individual commands are designated by respectively specified numerical values. Any of such numerical values is not restricted to a single one alone, and it is a matter of course that the amount of data can be reduced by omitting some specified commands depending on the storage capacity of the host computer 11 or that of each terminal apparatus 13.

Figure 5:
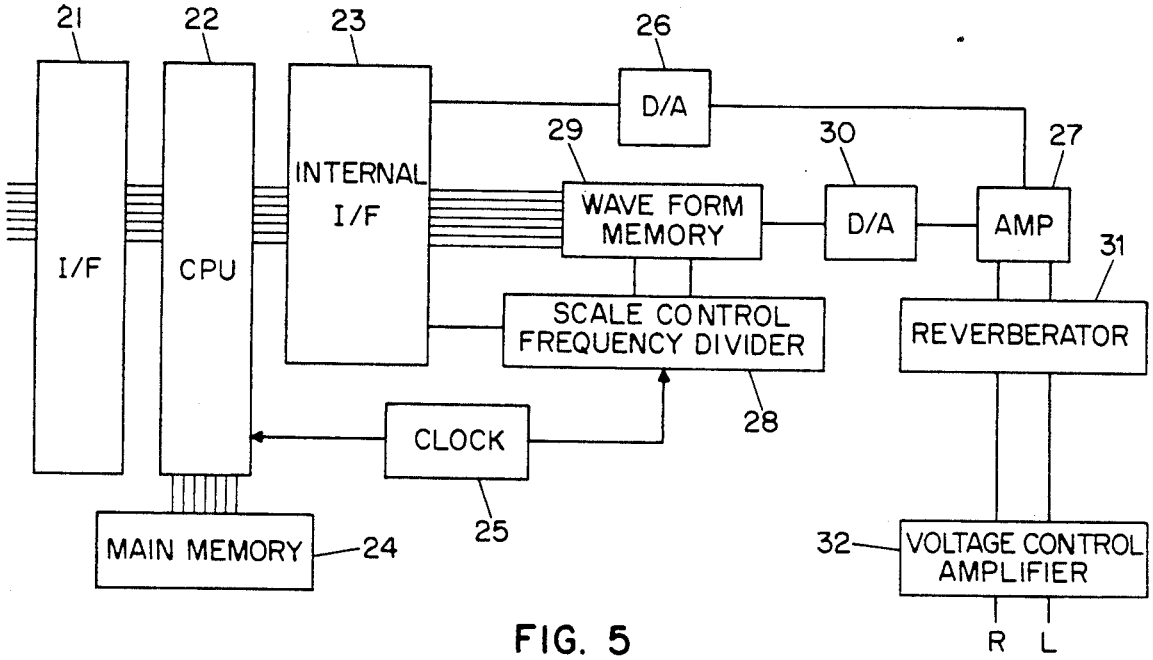
FIG. 5 is a block diagram principally showing the constitution for reproduction of music.

FIG. 5 is a block digram showing an exemplary arrangement contrived principally for reproduction of music in digital communication. There are included an interface 21 such as an I/O port; a CPU 22 for processing the input data received from the interface 21 and functioning to control each of the means connected mutually via two or multiple buses; an internal interface 23 for matching the CPU 22 to each of the means in the following stages; a main memory 24 for temporarily storing the data transferred thereto; a clock generator 25 incorporated in the CPU 22 and generating clock pulses of a predetermined frequency used to drive the CPU 22 while being utilized as a basis of the musical tempo or as a reference to determine the scale. The clock generator 25 is not limited to such internal type alone, and any external clock means may be employed as well. Further shown are a volume D/A converter 26 for converting into analog form the digital value of each sound designated in the music data processed by the CPU 22. Two of such converters are installed for stereophonic reproduction. The voltages outputted from the D/A converters 26 are applied to voltage control amplifiers 27 respectively. Denoted by 28 is a scale control frequency divider for dividing the frequency of the clock pulses obtained from the clock generator 25, thereby producing a desired frequency which corresponds to the designated scale in the music data. The frequency divider 28 is driven by the data inputted thereto from the internal interface 23. Further shown are waveform memories 29 for storing digital data obtained by sampling, analyzing and digitizing the characteristic analog waveforms of individual string or wind musical instruments. Each of the waveform memories 29 stores the sampling waveform of a specific musical instrument individually, and a plurality of such memories are existent in mutually equivalent relationship. When a control signal is fed from the CPU 22 via the internal interface 23, the data corresponding thereto is outputted to the waveform D/A converter 30. The signal converted into an analog form in this stage is then fed to the voltage control amplifier 27, where the analog signal is combined with another analog signal previously outputted from the volume D/A converter 26, and the resultant signal reproduced via the amplifier 32 is emitted as music from the loudspeaker. Denoted by 31 is a reverberator installed when necessary and serving to add the reverberation effect in accordance with the dimensions of a room for musical reproduction or with the physical properties of its wall surfaces.

Now the operation of the output unit will be described below. The music data in the form of a digital signal received by the interface 21 is composed of 8 bits and is transmitted to the main memory 24 via two buses. In this stage of the operation, the CPU 22 is held in its standby state until the music data is transmitted thereto. Subsequently the CPU 22 reads out the music data byte by byte from the main memory 24. The music data thus read out is formed in accordance with the pulses from the clock generator 25 when it is the time supervisory data. In the case of any other data relative to the start or stop of musical-note sound emission or the signal strength thereof, the data is converted into an analog form by the volume D/A converter 26. Meanwhile, in the case of scale data, it is inputted to the scale control frequency divider 28, which then generates a signal of the divided frequency obtained from the clock pulses. If the received data is composed of the signal for determining the tone, the specific sampling waveform stored in the memory 29 is fed to the waveform D/A converter 30, and the analog signal obtained therefrom is outputted to the voltage control amplifier 27. Then, as mentioned above, the amplifier 27 combines the analog amount of the D/A converter 26 with the analog signal of the D/A converter 30, thereby forming a resultant analog signal to be reproduced.

Figure 6:
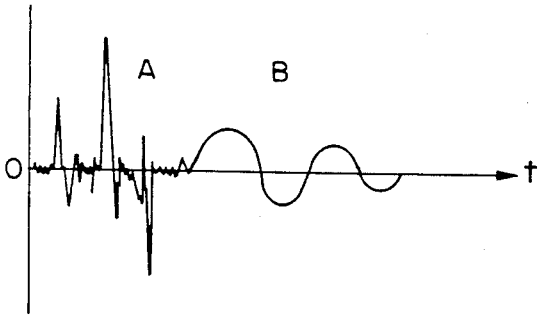
FIG. 6 graphically shows the waveform of a sampling signal.

FIG. 6 graphically shows the analog unit sampling waveform stored in the memory 29. Such waveform comprises an initial portion A and a repetitive portion B. That is, the waveform of each kind of musical instruments can broadly be classified into two characteristic forms. In the case of a piano, for example, one peculiar waveform is derived from an impact sound emitted by a piano wire and a hammer as a result of depressing a key, and another is an attenuated sound waveform of the piano wire. The impact sound has a momentary waveform like an initial noise, while the attenuated sound has a continuous sine waveform. Therefore, the piano tone can be reproduced by employment of proper means for sampling the initial impact sound waveform A and merely one unit portion of the subsequent attenuated repetitive waveform B, and then combining the two waveforms with each other at output time to gradually decrease the respective waveform. Consequently, it becomes possible to reduce the required storage capacity of the waveform memory 29 to a relatively small value.

Figure 7:
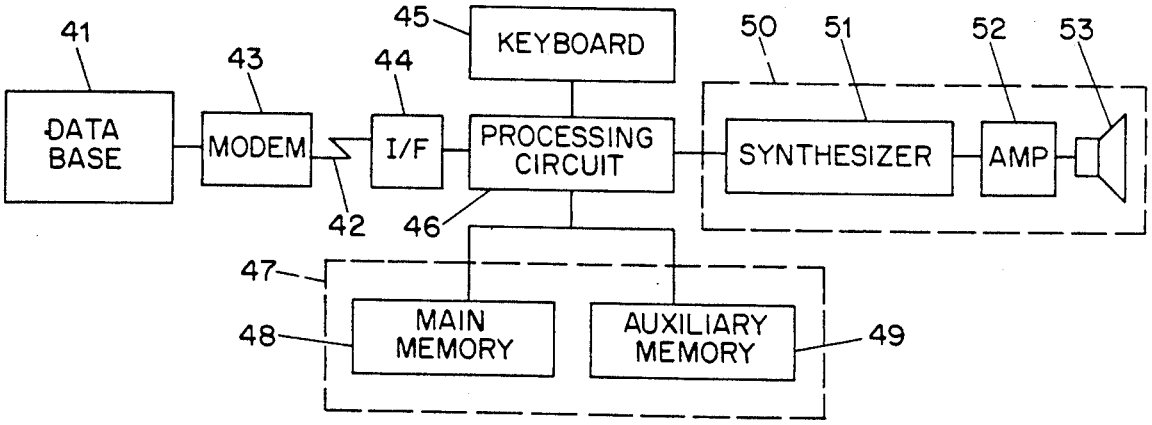
FIG. 7 is a block diagram principally showing the constitution of a first exemplary memory unit.

FIG. 7 is a block diagram showing principally the constitution of the memory unit, wherein there are included a host computer 41 having a data base to store composite music data, and a public communication line 42 for connecting terminal apparatus to the host computer 41 via a modem 43 and an interface 44. Also shown are a keyboard 45 serving as a selector means to select the desired music data for reproduction by inputting a numerical value; a processing circuit 46 for controlling the following-stage circuits such as memory means by feeding signals to the host computer 41 for selection of the music data; and memory means 47 consisting of a main memory 48 and an auxiliary memory 49 for storage of the music data. In the memory means 47, the main memory 48 has a function of storing merely the music data being reproduced. Meanwhile, the auxiliary memory 49 has a function of designating a plurality of music data for frequent reproduction and previously down-loading such data from the host computer 41, or a function of down-loading and storing surplus music data in the host computer 41 prior to transfer of such data to the main memory 48. In the auxiliary memory 49, there is ensured a storage capacity of about 300 musical pieces or songs. Further shown is a reproducing means 50 for converting the digital music data into an analog form and for reproducing the analog signal as instrumental music. The means 50 comprises three circuits of a synthesizer 51, an amplifier 52 and a loudspeaker 53.

Figure 8:
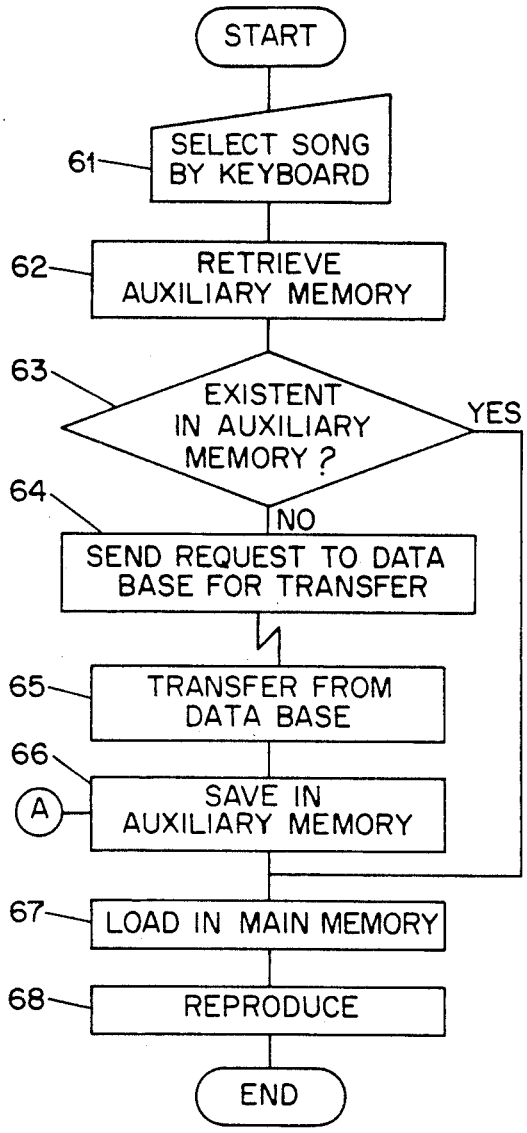
FIGS. 8 and 9 are flow charts of such memory unit.
Figure 9:
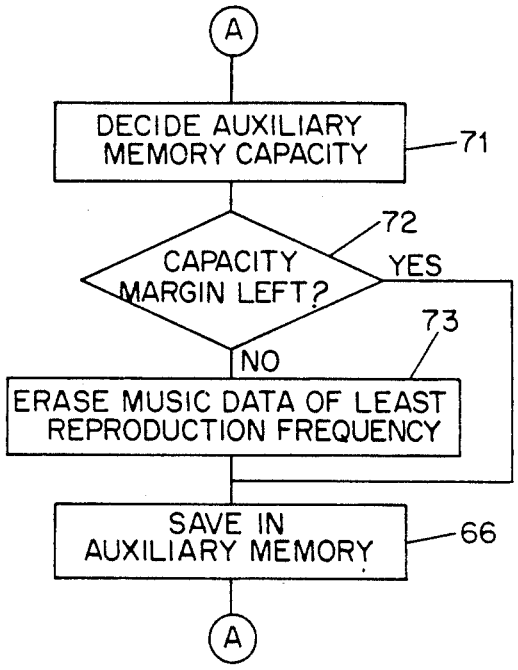

The apparatus of the present invention performs its operation in accordance with the procedure shown in the flow chart of FIG. 8. When a numerical value representing a data code is inputted [block 61] by manipulating the keyboard 45, the music data stored in the auxiliary memory 49 is retrieved [block 62] by the processing circuit 46. Then a decision is made [block 63] as to whether the selected music data is existent in the stored content of the auxiliary memory 49. If the result of such decision is affirmative (yes), the music data is loaded [block 67] in the main memory 49 and is reproduced by the means 50, so that the played instrumental music is outputted from the loudspeaker 53. Since the music data stored as the data base in the host computer 41 is previously encoded by a synthesizer, high-fidelity reproduction of the music can be attained by the use of another synthesizer 51 which has a complementary decoding function. If the selected music data is not existent in the stored content of the auxiliary memory 49 and the result of the decision in block 63 of FIG. 8 is negative (no), a request for transmission of such music data is sent [block 54] from the processing circuit 46 to the host computer 41 via the public communication line 42. The music data transmitted [block 65] to the apparatus in response to the above request is saved [block 66] first in the auxiliary memory 49 and, after being stored therein, the music data is loaded [block 67] in the main memory 48 via the processing circuit 46 and then is reproduced [block 68]. In FIG. 8, the branch A represents the operation performed when no margin is left in the storage capacity of the auxiliary memory 49. In such a case, the operation proceeds as shown in another flow chart of FIG. 9. First, a decision is made [block 71] as to whether any margin capacity is left or not in the auxiliary memory 49, and, if the result of such decision is negative [block 72], the music data reproduced least frequently in the past is erased [block 73] from the entire music data stored therein to consequently provide a margin in the capacity, and then the requested data is saved. When the result of the above decision is affirmative (yes) to indicate the existence of a storage margin, the data is saved directly in the auxiliary memory 49. Consequently, it is necessary for the individual composite music data to include the past reproduction frequency in addition to the data code. As for control of the auxiliary memory 49, the past reproduction frequency is retrieved, besides the above operation, per predetermined period counted by an internal timer, and any music data not used so frequently as to reach a preset number of loading times is erased so that the entire music data stored in the auxiliary memory 49 can be always maintained satisfactory and adequate.

Figure 11:
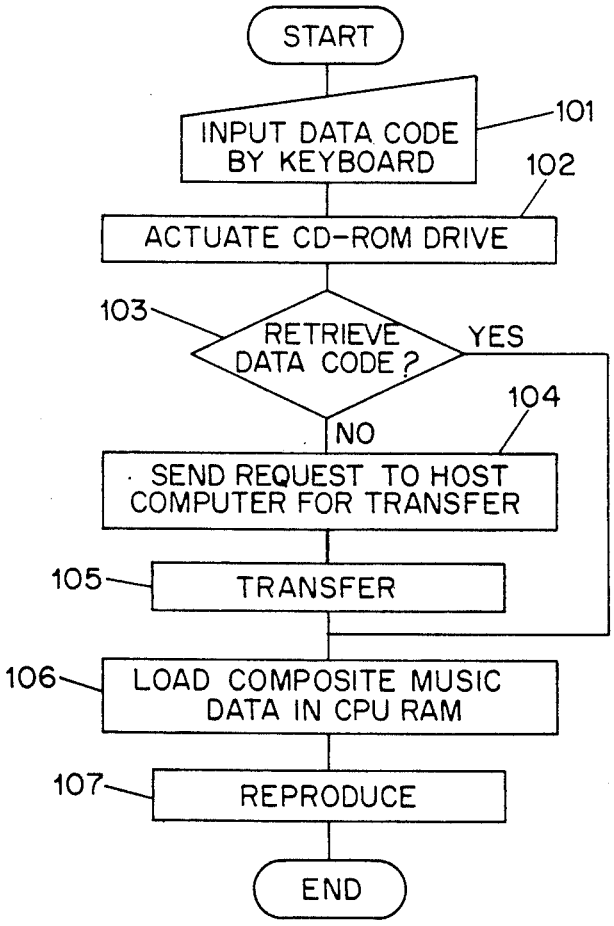
FIG. 11 is a flow chart of the memory unit shown in FIG. 10.
Figure 10:
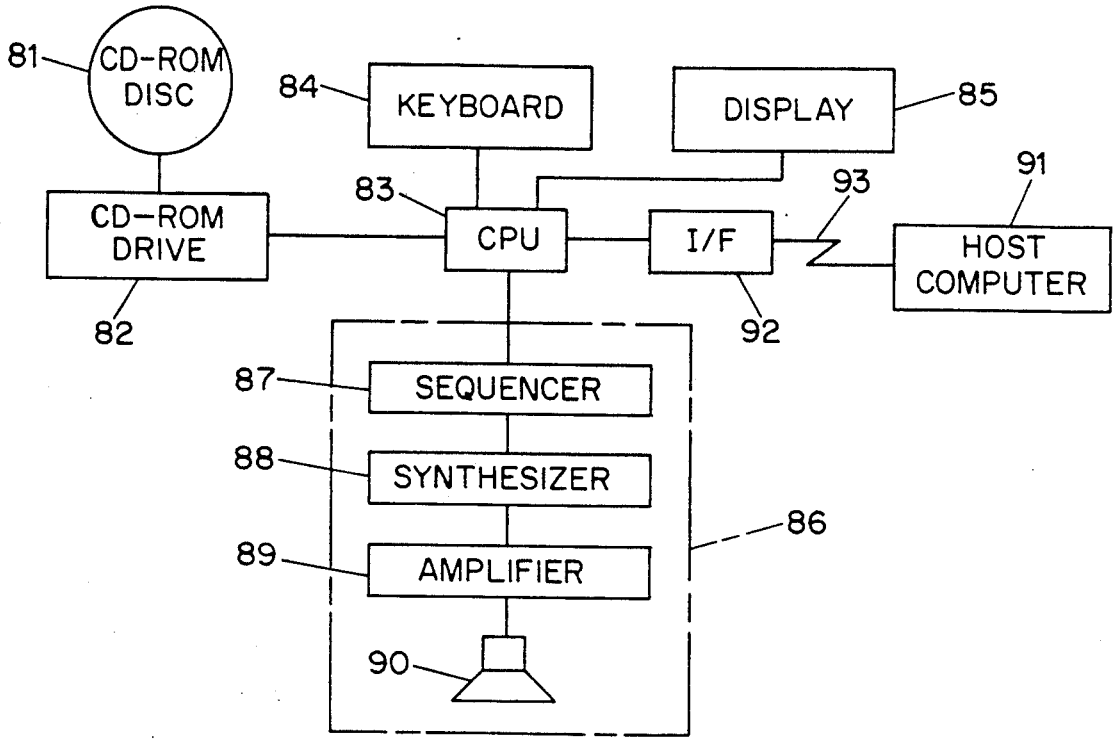
FIG. 10 is a block diagram principally showing the constitution of a second exemplary memory unit.

FIG. 10 is a block diagram of a second embodiment of the memory unit with a laser disc employed in the terminal apparatus of the invention, and FIG. 11 is a flow chart showing the operation procedure in the terminal apparatus. Since the use of a public communication line becomes expensive in case the data base is dependent entirely on the host computer, this embodiment is so contrived that any music pieces or songs requested frequently are stored on the terminal apparatus side, and the music data are loaded therefrom to curtail the expenditure of using the communication line. The term "optical disc" is not limited to a nonwritable CD-ROM alone, and includes a readable/writable CD-RAM and further an optical disc of another type that permits additional storage merely once. Denoted by 81 is a CD-ROM disc having a diameter of 12 cm and a storage capacity of 500 megabytes. Each musical piece or song is digitized by the aforementioned method to form instrumental music data while the words of each song are encoded similarly to form words data. Furthermore, key words representing the title, singer, composer, lyric writer and so forth of each song are added thereto with retrieval data having a data code, thereby forming composite music data of 83 kilobytes per song. The disc is capable of storing such composite music data corresponding to a maximum of about 6000 musical pieces or songs. Also shown are a CD- ROM drive mechanism 82; a CPU 83 connected to the CD-ROM drive mechanism 82 and having a function of controlling the same and loading one or more retrieved music data in the RAM; an input unit 84 (normally with a ten-key device or the like) for inputting the identification code or retrieval data for the desired music; a display device 85 for visually displaying the words data and so forth out of the composite music data; and a reproducing unit 86. The instrumental music data out of the composite music data loaded from the CD-ROM disc 81 into the CPU 83 by a sequencer 87 is fed to a synthesizer 88, whose output analog signal is amplified by an amplifier 89 and then is reproduced as music by means of a loudspeaker 90. Denoted by 91 is a host computer where any new song and so forth not yet stored in the CD-ROM disc 81 are added to renew the data base. The host computer 91 is connected to a public communication line 93 through the CPU 83 and the interface 92.

In the operation procedure of the memory unit, as shown in FIG. 11, first the data code or the like is inputted [block 101] from the input unit 84. Then the CPU 83 functions to actuate the CD-ROM disc drive mechanism 82 [block 102]. In case the input data is existent in the stored content, the result of a decision becomes affirmative (yes), so that the composite music data including the data code added thereto is obtained from the CD-ROM disc 81 and then is loaded [block 106] in the RAM incorporated in the CPU 83. Out of such composite music data, the words data is visually represented on the display device 85, and the instrumental music data is fed to the synthesizer 88 while being sequentially processed by the sequencer 87. After conversion into an analog form, the resultant signal is amplified by the amplifier 89 and then is emitted as reproduced music from the loudspeaker 90. Meanwhile, if the data designated by the numerical value from the input unit 84 is not existent in the CD-ROM disc 81, the result of the decision becomes negative (no), so that the CPU 83 immediately requests transmission of the desired music data to the host computer 91 via the public communication line [block 104]. And the music data transmitted [block 105] to the terminal apparatus is further transferred to the block 106 mentioned above.

The music data is designated by the data code or by inputting a key word representative of the title of the song or the like and retrieving the same from the stored data. In the latter case, the music data retrieval function can be further enhanced by an improved system which once displays a plurality of file data such as singers' names or composers' names on the display device 85 and then selecting the desired one therefrom.

Figure 12:
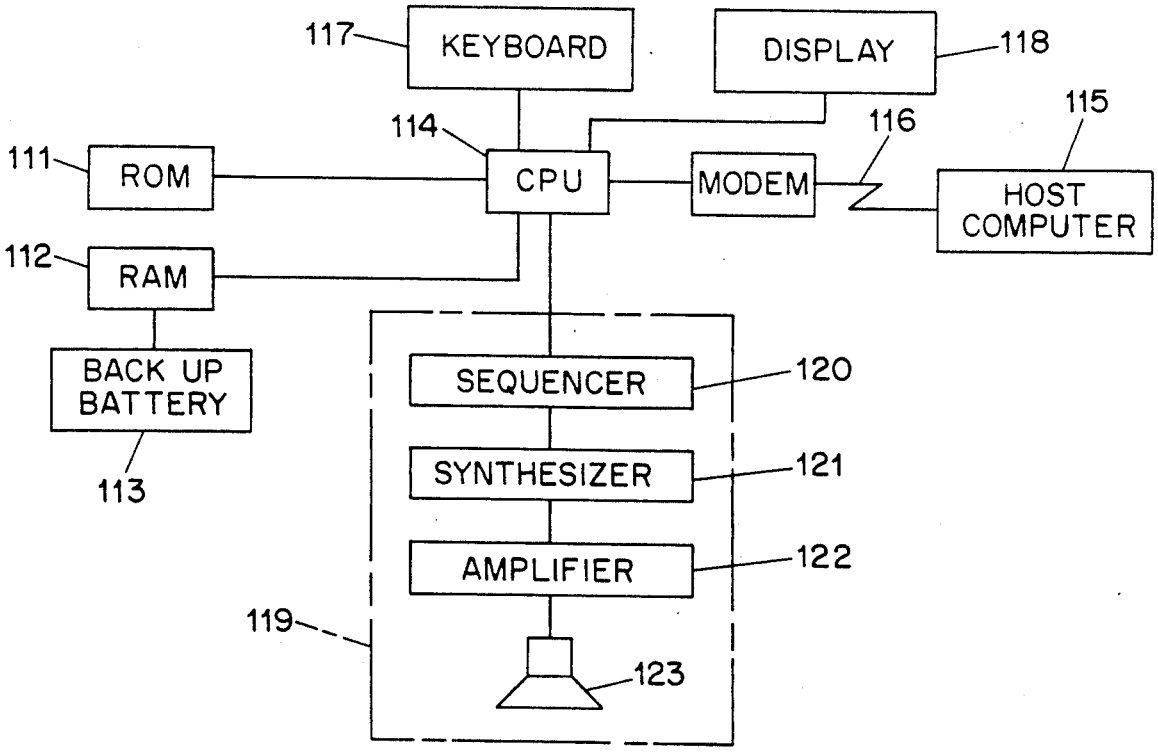
FIG. 12 is a block diagram principally showing the constitution of a third exemplary memory unit.
Figure 13:
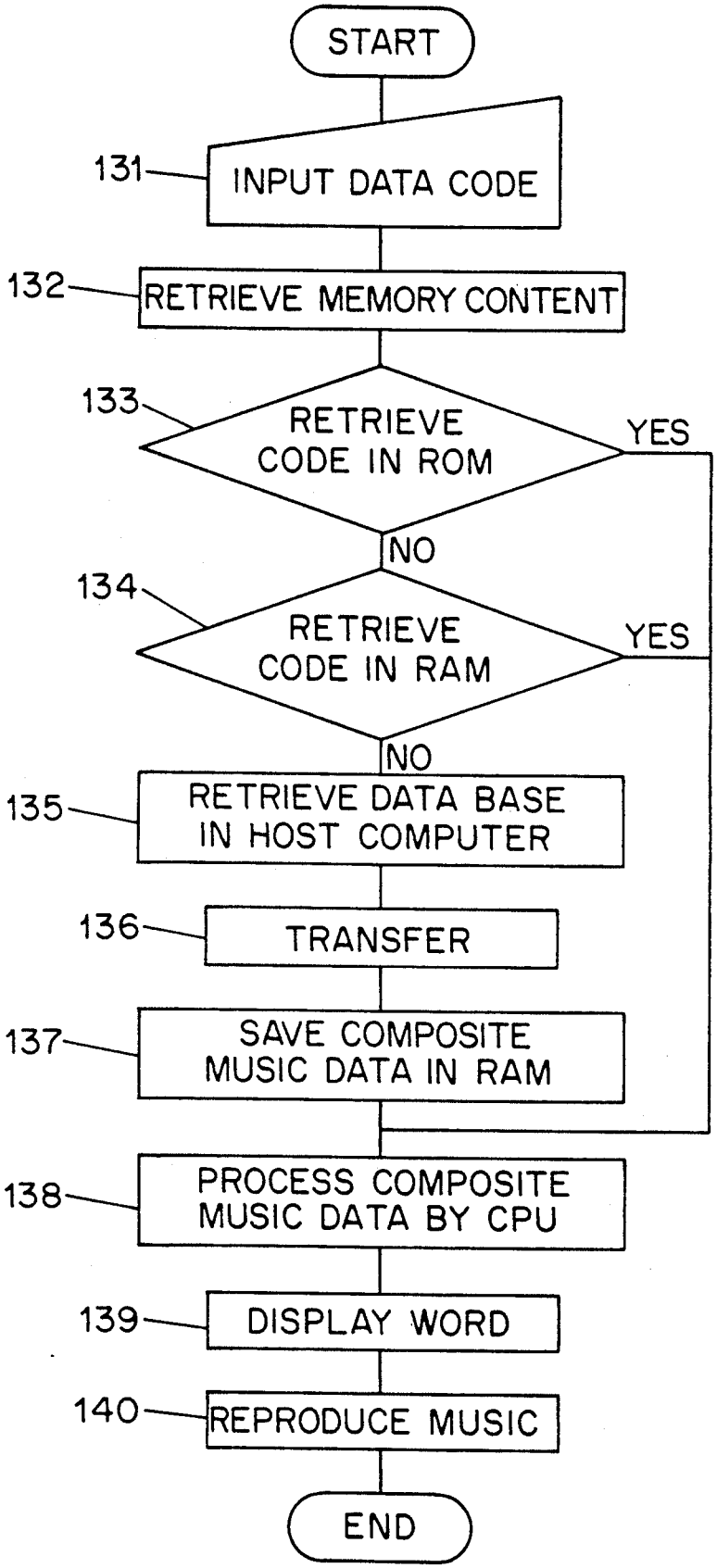
FIG. 13 is a flow chart of the memory unit shown in FIG. 12.

As for the memory unit, the arrangement can be modified by equipping the terminal apparatus with a main memory and an auxiliary memory. FIGS. 12 and 13 show a third embodiment having such modified arrangement. In the diagram, a ROM board 111 is provided with a plurality of additional semiconductor ROMs having a capacity to store music data of 2000 songs each composed of 85 kilobytes on the average. Denoted by 112 is a semiconductor RAM adapted for writing and reading music data of about 30 songs and backed up by a battery 113 so that the data are not erased despite turn-off or interruption of the power supply. Both the ROMs and RAMs employed here may be known products and are additionally installed to attain desired capacities. There are also shown a CPU 114 for controlling the ROM board 111 and the RAM 112; a host computer 115 for auxiliarily utilizing the data base which is composed of the music data not stored in the ROM board 111 or the music data requested least frequently; a digital or analog public communication line 116 for connecting the host computer 115 to terminal apparatus; an input unit 117 for receiving a data code and so forth for retrieval of desired music data to be reproduced; a display device 118 for visually representing the words data with characters out of the composite music data; and a reproducing unit 119 for outputting the instrumental music data, which is included in the composite music data fed to the CPU 114, to a sound source 121 such as a synthesizer, via a sequencer 120, then amplifying the output analog signal of the sound source 121 by an amplifier 122 and emitting the reproduced music from a loudspeaker 123.

The operation of the above apparatus will now be described below with reference to a flow chart of FIG. 13. First, when the data code for a request song is fed [block 131] from the input unit 117, the CPU 114 retrieves [blocks 132 and 133] the storage contents of the ROM board 111. And, if the result of a decision is affirmative (yes) to imply that the designated data code is found in such stored contents, the entirety of the composite music data is read out and processed by the CPU 114, and then its output is fed [block 138] to the sequencer 120 to execute both display of the words [block 139] and reproduction of the instrumental music [block 140]. Meanwhile, when the result of the decision in block 133 is negative (no), the stored content of the RAM 112 is retrieved. And, if the designated data code is found therein, the operation proceeds to block 138 in the same manner as the above. If the result of another decision is negative (no) in block 134 also, the data base of the host computer 115 is retrieved [block 135], and the composite music data with the designated data code is transmitted [block 136] to the terminal apparatus. Subsequently the music data is once saved [block 137] in the RAM 112, and then the operation proceeds to block 138 to execute both display of the words and reproduction of the instrumental music.

Figure 14:
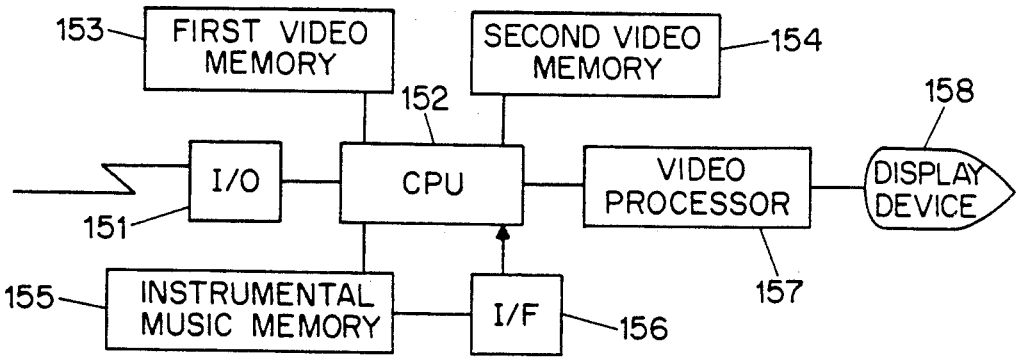
FIG. 14 is a block diagram principally showing the constitution of a first exemplary words display device.
Figure 15:
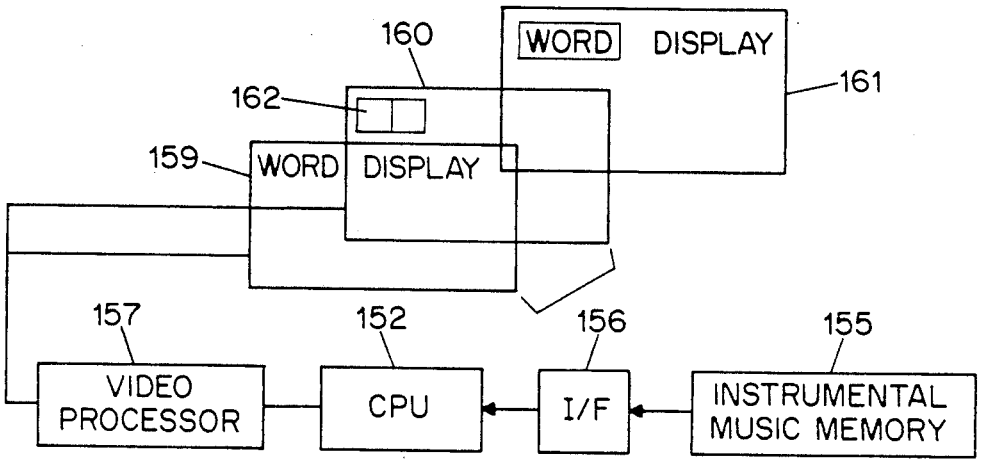
FIGS. 15 and 16 are schematic block diagrams of the words display device in FIG. 14.
Figure 16:
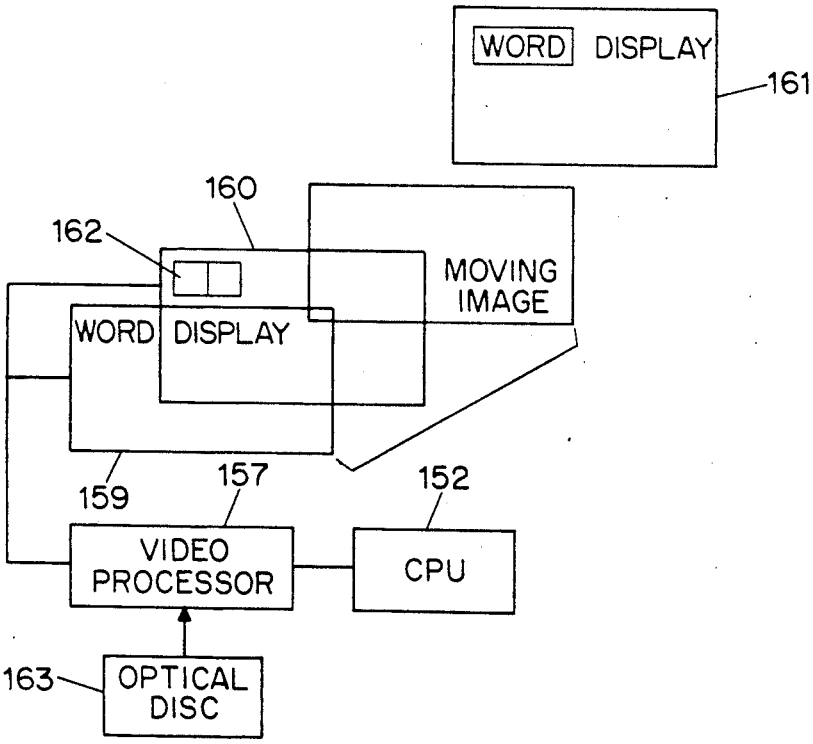

FIGS. 14 through 16 show an exemplary embodiment for visually representing the words on the display device, wherein connection to the external host computer is executed through digital communication. In the diagrams, there are included an I/O port 151 for inputting an external digital signal to the apparatus, and a CPU 152 for processing the external data received. The CPU 152 processes both the instrumental music data and the words data simultaneously. A single CPU may be employed for common use as in this embodiment, or separate CPUs may be employed and driven synchronously with each other via a bus for individually processing the instrumental music data and the words data. Also shown are a first video memory (VRAM) 153 having a storage capacity for the words data of a single song out of the entire data transmitted thereto; and a second video memory (VRAM) 154 having the same storage capacity as that of the first VRAM 153 and serving to store the position of a window for sequential display of preset unitary words data. In this embodiment, the words data is composed of a maximum of 8 kilobytes or so. Since each of the VRAMs 153 and 154 needs to have a sufficient storage capacity for displaying one complete image on the screen, a capacity of more than 256 kilobytes is prepared. In the words data, a line feed code is included at each of predetermined positions for display of words. Also shown are an instrumental music memory 155 for storing the instrumental music data out of the composite music data; and an interface 156 for outputting to the CPU 152 a color change signal included in the digital signal obtained from the instrumental music memory 155. The color change signal serves to shift the window position forward while properly changing the colors of both the words and the background. Further shown is a video processor 157 having a function of converting the digital signal into video signal after the storage data in the first and second VRAMs 153, 154 have been processed by the CPU 152. Denoted by 158 is a display device consisting of a CRT or liquid crystal panel and serving to display the entire words while following up the position thereof relative to the song being reproduced and changing the colors of both the words and the background.

Referring now to FIG. 14, a description will be given with regard to the data processing in the above arrangement. First the composite music data transferred from the external data base via the I/0 port 151 is so processed that the words data is stored in the first VRAM 153 while the instrumental music data is stored in the music memory 155. Subsequently the apparatus performs its operation in accordance with the respective storage contents. The CPU 152 analyzes the instrumental music data and converts the same into a music signal while taking out the words data from the first VRAM 153 and visually representing the words on the display device 158 via the video processor 157. The color change signal included in the data obtained from the instrumental music memory 155 is fed to the CPU 152 via the interface 156, whereby the window position stored in the second VRAM 154 is shifted forward. When necessary, the signal for changing the background color of the display device 158 is outputted to the video processor 157, and the content thereof is combined with the content of the first VRAM 153, so that the combined data is visually represented on the display device 158. In this case, if the character color and the background color in the window are so designated as to become the same, the words already sung are sequentially erased on the screen of the display device 158. If the designation is so executed as to change the background color at each clause or phrase, the visual effect is rendered more conspicuous. In FIG. 15, there are shown storage content 159 of the first VRAM 153; storage content 160 of the second VRAM 154; combined content 161 visually represented on the display device; and a window 162 illustrated conceptionally. The color change signals may be intermingled with the instrumental music data in such a manner that one bit thereof becomes a pulse output, so that the words can be advanced on a character-by-character basis simultaneously with the processing of the instrumental music data. However, it is necessary that chromatic data be intermingled additionally for the color changing purpose. Meanwhile, if a plurality of bits are allocated to the color change signal, it becomes possible to erase plural characters at a time or to change the colors simultaneously. Furthermore, a desired number of characters from the start of reproduction of the musical piece or song can be designated for erasure by employing a greater number of bit strings.

In this case, even when the song is reproduced from any of its mid portions, the above visual representation can be performed accurately in compliance with progression of the instrumental music. Although the window 162 may be formed with a fixed capacity as in the embodiment mentioned, a modification is possible in such a manner that the capacity is varied to increase successively and the portion from the beginning of the words to the end thereof is treated as a single window.

FIG. 16 is a block diagram of another example different from the foregoing one shown in FIG. 15. If moving-image data stored in an optical disc 163 is superimposed by a video processor, the background can be turned into a moving image without being limited merely to a still image alone, hence achieving greater visual effect.

Figure 17:
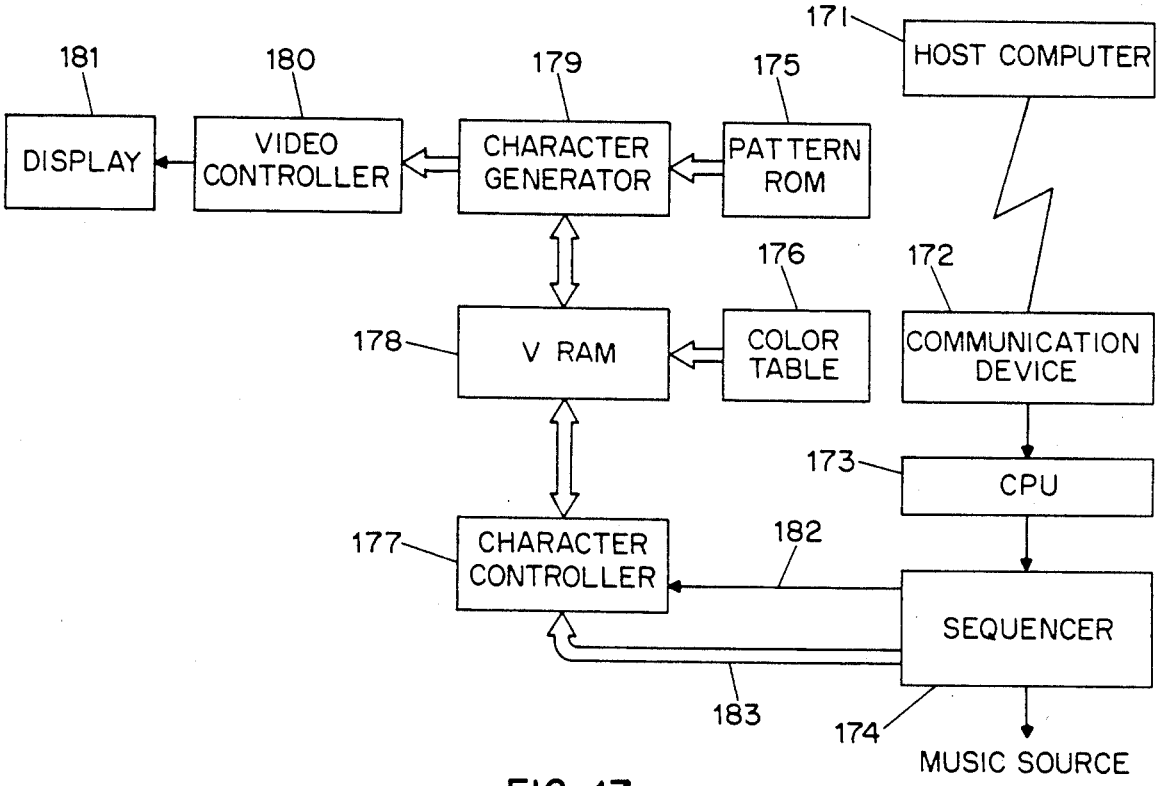
FIG. 17 is a block diagram showing a second exemplary words display device.

FIG. 17 shows a second embodiment contrived for displaying words, wherein instrumental music data and words data are processed sequentially and individually by means of a sequencer. There are included a host computer 171 installed externally; a communication device 172 such as an interface or modem; a CPU 173 for computing and processing the composite music data down-loaded from the host computer 171, and including an input unit and a memory unit for storing the music data; a sequencer 174 having a function of feeding the instrumental music data, out of the composite music data, sequentially to a sound source such as MIDI, and further feeding the words data to the next stage separately from the instrumental music data; a pattern ROM 175 having data of a registered pattern inclusive of characters, symbols and so forth; a color table 176 having data to designate a plurality of colors; a character controller 177 for visually representing the entire words data, which is stored in a VRAM 178, on the below-mentioned display device 181 while controlling progression of the words and change of the background color in accordance with the signal obtained from the sequencer 174; a character generator 179 for reading out the character data from the pattern ROM 175 and visually representing such data in the form of a dot matrix on the display device 181; and a video controller 180 for visually representing on the display device 181 the character pattern converted by the character generator 179 and controlling the display device 181 in response to the signal obtained from the character controller 177. A single-line arrow illustrated in FIG. 17 indicates the path of the signal controlled by the composite music data, and a double-line arrow indicates the flow of the data. The single-line arrow 182 directed from the sequencer 174 to the character controller 177 corresponds to a trigger signal intermixed with the instrumental music data for indicating the progression state of the music reproduction in relation to the displayed words and thereby controlling the progression of the words or changing the background color. Meanwhile, the double-line arrow 183 indicates the flow of the words data. In the operation performed by the arrangement disclosed hereinabove, first the desired composite music data is called by the data code or the like obtained by manipulating the input unit incorporated in the CPU 173. Then the composite music data is downloaded from the host computer 171 via the public communication line and is stored in the memory unit. The data thus stored is computed and processed by the CPU 173, and the instrumental music data out of the entire data is inputted to the sound source via the sequencer 174, while the words data is inputted to the character controller 177 via the sequencer 174 and then is stored in the VRAM 178. The designated characters in the words data thus stored are read out from the pattern ROM 175 prior to reproduction of the music and, after being formed into a dot matrix by the character generator 179, the characters are visually represented on the display device 181 via the video controller 180. Upon subsequent reproduction of the music, the sequencer 174 functions to process the instrumental music data sequentially. A trigger signal is intermixed with the instrumental music data so as to synchronize the words with the music reproduction, and also a trigger signal for changing the background color of the display device 181 is intermixed at a proper position. As indicated by the arrow 182, the trigger signals are fed sequentially to the character controller 177 from the sequencer 174. Therefore, with regard to progression of the words, the word position relative to the music portion being reproduced can be indicated by an arrow after the words data is processed by the video controller 180 through the character generator 179, and the color of the words already sung is changed or the visual representation of the words is linked to the reproduction of the music. As for the background color, the color designation is read out from the color table 176 by the character controller 177, and the background color is changed on the display device 181 in accordance with the signal. Thus, even in the case where both the instrumental music data and the words data constituting binary-coded composite music data are stored in a single file, it is still possible to accurately synchronize the visual representation of the words on the display device with the operation of reproducing the music.

What is claimed is:

1. A music-reproducing and words-displaying apparatus connected via public communication line to a host computer having a data base of binary-coded music and words, wherein a data unit of said data base comprises composite music data including binary-coded instrumental music data, binary-coded words data, and a data code for retrieval of said data unit from said data base, said apparatus comprising:

selection means for selecting desired composite music data by designation of said data code;

memory means for storing the composite music data thus selected;

operating means for processing said selected composite music data;

conversion means for converting into an analog form a signal processed by said operating means;

amplifier means for amplifying the analog signal thus obtained; and display means for visually representing words corresponding to said words data;

said memory means comprising a main memory for storing selected composite music data, and an auxiliary memory for storing a plurality of data units transmitted from said data base.

2. The apparatus of claim 1, wherein said main memory comprises a first video memory for storing said words data, and a second video memory for storing display-window information under control of synchronization signals included with said music data.

3. The apparatus of claim 2, wherein said display device is adapted to display different colors, said second video memory being further adapted to store color-change information included with said music data.

4. The apparatus of claim 3, color-change information specifying the color of words display.

5. The apparatus of claim 3, color-change information specifying the color of background display.

6. The apparatus of claim 3, said processing means comprising a sequencer, a character controller connected to said sequencer, a character generator connected to said character controller, and a video controller connected to said character generator, said sequencer being adapted to feed music data to a sound source and words data to said character controller, said character controller being adapted to communicate with said main memory and to refer to a color table associated with said main memory, said character generator being adapted to communicate with said main memory, to refer to a pattern table associated with said character generator, and to convert a pattern into a form suitable for display by said display means.

7. The apparatus of claim 1, wherein said main memory comprises a random-access memory.

8. The apparatus of claim 7, wherein said random-access memory comprises a semiconductor memory.

9. The apparatus of claim 8, wherein said semiconductor memory comprises a back-up power supply.

10. The apparatus of claim 1, wherein said auxiliary memory means comprises an optical disc and a drive mechanism for said optical disc.

11. The apparatus of claim 10, wherein said optical disc is adapted to be written on under control of said operating means.

12. The apparatus of claim 1, wherein said auxiliary memory comprises a read-only semiconductor memory.

13. The apparatus of claim 1, further comprising a source of moving-image video data connected to said display means.

14. An apparatus connected via a public communication line to a host computer having a data base of binary-coded composite music data and adapted to transmit music data, said apparatus comprising:

a data interface to said public communication line;

a CPU for processing music data transmitted through said interface;

memory means for temporarily storing instrumental music data included in said composite music data;

a plurality of waveform memories for storing waveform signals obtained by previously sampling the tones of individual musical instruments and encoding such tones;

a scale control frequency divider for generating pulses of a desired frequency by dividing the frequency of clock pulses used to drive said CPU;

a sound volume D/A converter for changing the sound volume in conformity with sound intensity data included in said instrument music data;

a waveform D/A converter for converting into an analog signal a waveform selected from said waveform memories;

a voltage control amplifier for controlling the output signals of said D/A converters; and a display device for visually representing words corresponding to words data included in said composite music data;

wherein processing of said words data is controlled by said clock pulses, and a desired musical piece or song is reproduced while the words thereof are synchronously represented on said display device;

said memory means comprising a main memory for storing selected composite music data, and an auxiliary memory for storing a plurality of data units transmitted from said data base.

15. The apparatus of claim 14, wherein said main memory comprises a first video memory for storing said words data, and a second video memory for storing display-window information under control of synchronization signals includes with said music data.

16. The apparatus of claim 14, further comprising a reverberator connected to said voltage control amplifier and adapted to add a reverberation effect to a sound signal.

17. The apparatus of claim 14, wherein said main memory comprises a random-access memory.

18. The apparatus of claim 17, wherein said random-access memory comprises a semiconductor memory.

19. The apparatus of claim 18, wherein said semiconductor memory comprises a back-up power supply.

20. The apparatus of claim 14, wherein said auxiliary memory comprises an optical disc and a drive mechanism for said optical disc.

21. The apparatus of claim 20, wherein said optical disc is adapted to be written on under control of said operating means.

22. The apparatus of claim 14, wherein said auxiliary memory comprises a read-only semiconductor memory.

23. The apparatus of claim 14, further comprising a source of moving-image video data connected to said display means.

24. The apparatus of claim 14, said processing means comprising a sequencer, a character controller connected to said sequencer, a character generator connected to said character controller, and a video controller connected to said character generator, said sequencer being adapted to feed music data to a sound source and words data to said character controller, said character controller being adapted to communicate with said main memory and to refer to a color table associated with said main memory, and said character generator being adapted to communicate with said main memory, to refer to a pattern table associated with said character generator, and to convert a pattern into a form suitable for display by said display means.

* * * * *